US005743608A

United States Patent [19]

Johannes

[11] Patent Number: 5,743,608

[45] Date of Patent: Apr. 28, 1998

[54] DRAWER

[75] Inventor: Hämmerle Johannes, Hochst, Austria

[73] Assignee: Grass AG, Austria

[21] Appl. No.: 720,939

[22] Filed: Oct. 4, 1996

[30] Foreign Application Priority Data

Nov. 9, 1995 [DE] Germany ..... 295 17 683.0

[51] Int. Cl.[6] ..... A47B 88/00

[52] U.S. Cl. ..... 312/348.1; 312/348.2; 312/330.1; 312/349; 403/231

[58] Field of Search ..... 312/348.1, 348.2, 312/348.4, 334.12, 349, 330.1; 403/245, 230, 231

[56] References Cited

U.S. PATENT DOCUMENTS

| | | | |
|---|---|---|---|
| 2,678,866 | 5/1954 | Merrett | 312/349 |
| 4,099,815 | 7/1978 | Cox et al. | 312/348.2 |
| 5,348,386 | 9/1994 | Grass | 312/348.2 |
| 5,538,339 | 7/1996 | Rock et al. | 312/348.1 |

FOREIGN PATENT DOCUMENTS

| | | | |
|---|---|---|---|
| 1061848 | 9/1979 | Canada | 312/348.1 |
| 2755527 | 6/1978 | Germany | 312/348.2 |
| 2702217 | 7/1978 | Germany | 312/348.1 |
| 3911353 | 10/1990 | Germany | 312/348.1 |
| 1412723 | 7/1988 | U.S.S.R. | 312/348.1 |
| 1536536 | 12/1978 | United Kingdom | 312/348.1 |

*Primary Examiner*—Jose V. Chen
*Assistant Examiner*—James O. Hansen
*Attorney, Agent, or Firm*—Kilpatrick Stockton LLP

[57] ABSTRACT

A drawer slide which forms a side wall of a drawer has outwardly curving holding devices in the form of a first shoulder projection with a tab and a second shoulder projection offset to one another in a back wall area of the drawer slide which engage in corresponding bore holes of a back wall and secure the back wall against shifting.

7 Claims, 2 Drawing Sheets

DRAWER

BACKGROUND AND FIELD OF THE INVENTION

The invention pertains to a drawer with a drawer slide which forms a side wall of the drawer and which has outwardly curving holding devices in a back area of the drawer slide that engage in the drawer back wall and secure the drawer back wall against shifting in the vertical and horizontal direction.

The described drawer is well suited for quick assembly, and, especially for the "tool-free" assembly (no tools required) of a drawer back wall made of wood.

A drawer of this type, for example, was made known by the disclosure publication DE 27 02 217. This document describes a drawer, especially a drawer side wall, which makes an easy assembly of solid walls, especially the front, back and bottom walls, possible. The drawer side wall is formed as a plate type profile rail and has on its front side, backside and underside, outwardly bent holding devices for the front walls, back walls, and bottom walls.

A drawer of this type is especially disadvantageous for the fastening of the back wall, because the holding device for the back wall is formed so that the back wall is secured against shifting based on the inward pressure. However, a push or pressure on the outer part of the back wall results in the back wall shifting or even in the drawer falling in or collapsing.

The object of the present invention is based on the task of further developing and improving the aforementioned drawer so that a quick and secure fastening of the back wall becomes possible and is still secured against shifting in any direction.

SUMMARY OF THE INVENTION

A fundamental feature of the invention is that in the back wall area of the drawer slide or drawer slide or drawer guide, which also forms a side wall of the drawer and is referred to herein as the drawer Zargen slide, there are holding devices that curve out from the drawer Zargen slide or Zargen guide, and these holding devices engage in the back wall and secure it against shifting in the vertical and horizontal direction.

This is achieved by the shoulder projections, formed in the back area of the drawer Zargen slide, which engage in the bore holes of the back wall. Preferably, two shoulder projections are formed on each Zargen slide, so that the first shoulder projection engages from behind in the back wall and the second shoulder projection engages in a perpendicular direction to the face side of the back wall.

The combined action of both shoulder projections ensures not only that the back wall is secured against vertical shifting, but also that it is held steady in the horizontal direction so that inward or outward pressure on the drawer will not result in shifting.

Preferably, the holding devices are placed in the horizontal and also vertical direction. This increases the attainable stability.

The invention related objectives of the submitted invention results from not only the matter of the particulars of the protection claims, but also the various combinations of the individual protection claims.

All records, documents and evidence, inclusive of the abstract, open and disclosed statements and declarations and indications and features, especially those represented embodiments in the drawings, will be claimed as fundamental and significant inventions, as far as the claims individually or in combinations are relative to the position that the technology is new.

The invention at hand will be explained more precisely by the various embodiments shown by the representational drawings. Hereby, additional significant features and advantages of the innovation will be concluded from the designs and their descriptions.

DESCRIPTION OF THE PREFERRED EMBODIMENT

Figure 1:
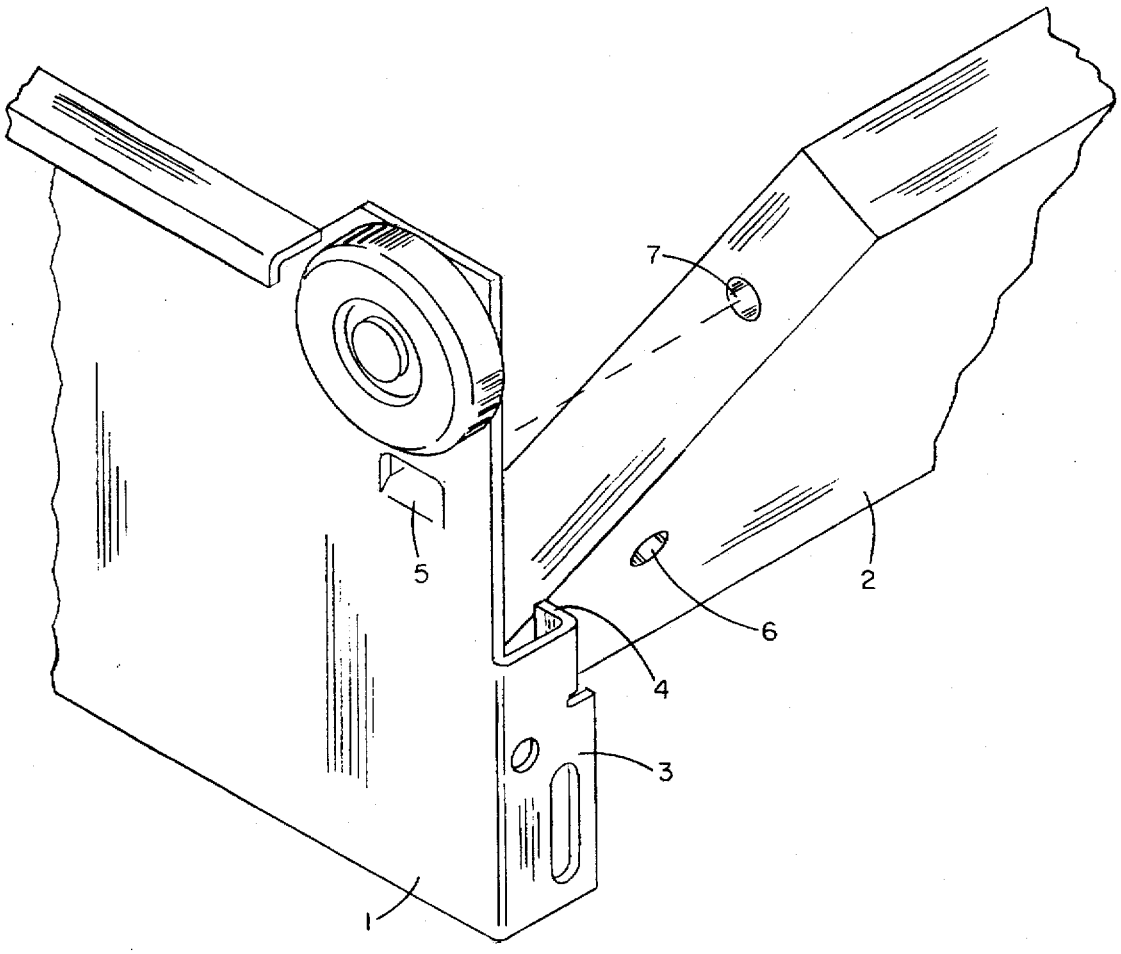
FIG. 1: a perspective view of the drawer with the drawer Zargen slide and back wall during the assembly.

FIG. 1 shows the drawer, especially the back section of the drawer, during the assembly of the back wall. One sees the drawer Zargen slide (1), which is also the drawer side wall, and, simultaneously, is the guide rail of the drawer. The drawer Zargen slide (1) has in its back area a somewhat rectangular bent tab (3). On the tab (3) a shoulder projection (4) is curved out, which points somewhat towards the front side of the drawer.

Furthermore, the drawer Zargen slide (1) has in its back area, a shoulder projection (5) which, preferably, is bent out of the material of the drawer Zargen slide (1) itself. This shoulder projection (5) points into the drawer. Naturally, it is equally possible to design the shoulder projection (5) as a screw, a bolt, or a welded-on tab.

The roller track (11) supports the drawer Zargen slide (1) in its operation as a guide slide.

Moreover, one sees the back wall (2) that has a bore hole (6) on its back side and, preferably, has a bore hole (7) on its side.

It is provided that the shoulder projections (4 and 5) of the drawer Zargen slide (1) engage in the corresponding bore holes (6 and 7) of the back wall (2), and, thereby, the back wall (2) is held to the drawer Zargen slide (1).

The back wall (2) consists preferably of wood, but can also be made of plastic. In order to mount the back wall, the back wall is placed slightly tilted so that its bottom edge points towards the drawer space. Then the back wall (2) is placed, face and back, with the bore holes (7) on the respective shoulder projection (5). Now the back wall is turned perpendicular. Then the shoulder projection (4) engages in the back side bore hole (6) of the side wall (2).

When the drawer bottom (8) is inserted, which is after the back wall (2) is mounted, the back wall is then even more stabilized.

Figure 2:
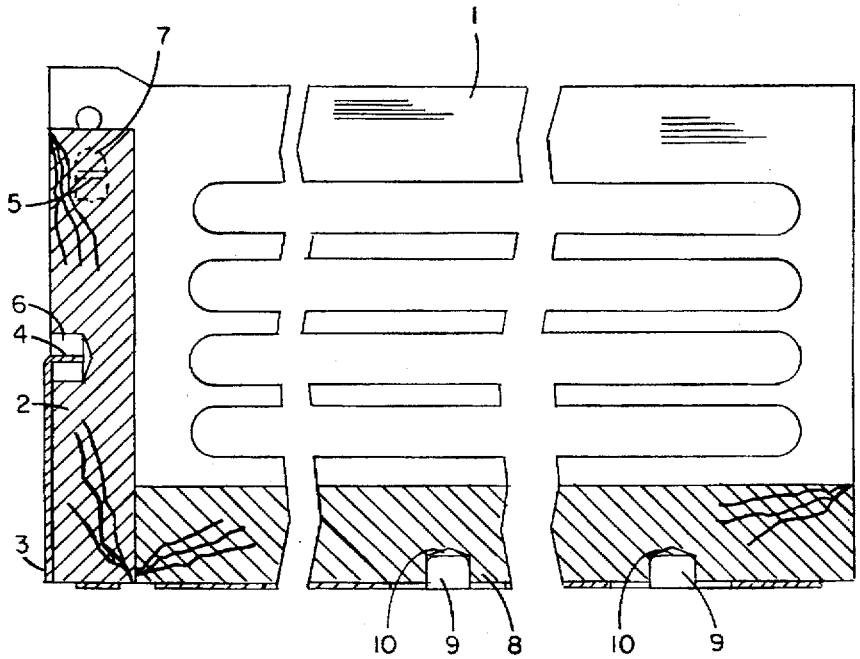
FIG. 2: a sectional view through the drawer along the lengthwise side of the drawer Zargen slide.
Figure 4:
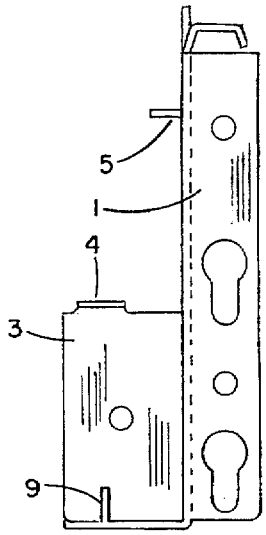
FIG. 4: a front view of the drawer Zargen slide.
Figure 3:
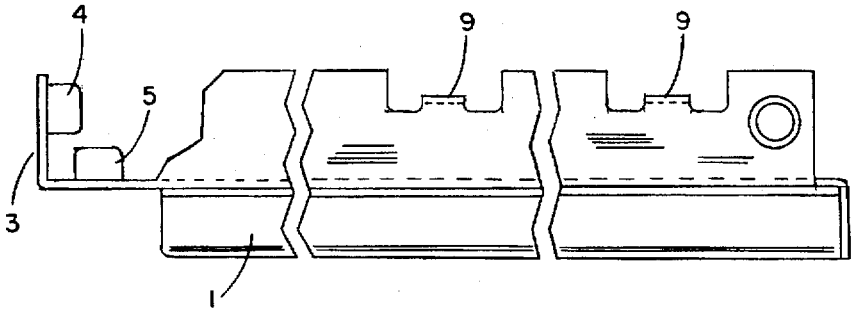
FIG. 3: a top view of the drawer Zargen slide.

Please refer to the embodiments in FIGS. 2 to 4 for additional clarifications. It should be noted again the drawer Zargen slide (1) on whose back side area, the shoulder projections (4 and 5) are formed. These shoulder projections engage in the corresponding bore holes (6 and 7) of the back wall (2). In the same manner, the drawer Zargen slide (1) has on its underside a shoulder projection (9) which engages in the corresponding bore hole (10) of the drawer bottom (8). After the drawer bottom is inserted, it rests in the lower area of the back wall so that the back wall (2) is then even more protected from shifting.

It should be noted that the shoulder projections (4 and 5) of the drawer Zargen slide (1) are arranged preferably in the horizontal, as well as the vertical position, opposing each other in order to have a better division of strength and to secure the back wall (2) sufficiently.

| Drawings Legend |
|---|
| 1. Drawer Zargen slide (side wall) |
| 2. Back wall |
| 3. Tab |
| 4. Shoulder projection |
| 5. Shoulder projection |
| 6. Bore hole |
| 7. Bore hole |
| 8. Drawer bottom |
| 9. Shoulder projection |
| 10. Bore hole |
| 11. Roller track |

I claim:

1. A drawer component comprising a drawer slide which forms a side wall of a drawer, the drawer slide having a back wall area and a front wall area, wherein the drawer slide has outwardly curving holding devices in the back wall area of the drawer slide adapted to engage in a back wall and adapted to secure the back wall against shifting in vertical and horizontal directions, the holding devices including a tab bent out of the back wall area of the drawer slide substantially perpendicular to the drawer slide, with a first shoulder projection formed on the bent tab, the first shoulder projection extending substantially perpendicular to the bent tab toward the front wall area of the drawer slide and being adapted to engage in a corresponding bore hole of the back wall, and a second shoulder projection bent out of the back wall area of the drawer slide and extending substantially perpendicular to the drawer slide and likewise adapted to engage in a corresponding bore hole in the back wall.

2. A drawer component according to claim 1, wherein a drawer bottom rests in a lower area of the back wall and additionally prevents horizontal shifting.

3. A drawer compenent according to claim 1, wherein the first and second shoulder projections are placed offset in one of a horizontal and vertical direction.

4. Drawer, according to claim 1, wherein a drawer bottom rests in a lower area of the back wall and additionally prevents horizontal shifting.

5. A drawer component according to claim 1, wherein said drawer slide has a top and bottom, said first shoulder projection is spaced from the bottom of the drawer slide, and said second shoulder projection is spaced between the first shoulder projection and the top of the drawer slide.

6. A drawer component according to claim 1, wherein said drawer slide has a top and bottom, and the drawer slide has at least one additional shoulder projection which is formed on the bottom of the drawer slide and extends substantially parallel to the drawer slide toward the top of the drawer slide, and which is spaced between the front wall and back wall areas of the drawer slide and adapted to engage a drawer bottom.

7. A drawer component according to claim 1, wherein said first shoulder projection engages a first bore hole formed on a back side of the back wall extending parallel to the drawer slide, and the second shoulder projection engages a second bore hole formed in an end of the back wall extending perpendicular to the drawer slide.

* * * * *